US006672391B2

(12) United States Patent
Anderson et al.

(10) Patent No.: US 6,672,391 B2
(45) Date of Patent: Jan. 6, 2004

(54) SUBSEA WELL PRODUCTION FACILITY

(75) Inventors: Clay F. Anderson, Katy, TX (US); John Allen, Houston, TX (US)

(73) Assignee: ABB Offshore Systems, Inc., Houston, TX (US)

( * ) Notice: Subject to any disclaimer, the term of this patent is extended or adjusted under 35 U.S.C. 154(b) by 0 days.

(21) Appl. No.: 10/408,734

(22) Filed: Apr. 7, 2003

(65) Prior Publication Data

US 2003/0188873 A1 Oct. 9, 2003

Related U.S. Application Data

(60) Provisional application No. 60/371,217, filed on Apr. 8, 2002.

(51) Int. Cl.[7] ..... E21B 29/12

(52) U.S. Cl. ..... 166/357; 366/352; 366/267

(58) Field of Search ..... 166/357, 366, 166/352, 267

(56) References Cited

U.S. PATENT DOCUMENTS

| | | | | | |
|---|---|---|---|---|---|
| 2,953,204 | A | * | 9/1960 | Doscher et al. | 166/266 |
| 3,221,816 | A | * | 12/1965 | Shatto, Jr. et al. | 166/357 |
| 3,261,398 | A | * | 7/1966 | Haeber | 166/352 |
| 3,504,741 | A | * | 4/1970 | Baker et al. | 166/356 |
| 3,590,919 | A | * | 7/1971 | Talley, Jr. | 166/357 |
| 3,621,911 | A | * | 11/1971 | Baker et al. | 166/336 |
| 3,643,736 | A | * | 2/1972 | Talley, Jr. | 166/356 |
| 4,438,817 | A | * | 3/1984 | Pokladnik et al. | 166/341 |
| 4,527,632 | A | * | 7/1985 | Chaudot | 166/357 |
| 4,705,114 | A | * | 11/1987 | Schroeder et al. | 166/357 |
| 5,154,741 | A | * | 10/1992 | da Costa Filho | 96/157 |
| 5,950,732 | A | * | 9/1999 | Agee et al. | 166/354 |
| 6,004,385 | A | * | 12/1999 | Birmingham | 96/174 |
| 6,068,053 | A | * | 5/2000 | Shaw | 166/267 |
| 6,129,150 | A | * | 10/2000 | Lima | 166/357 |
| 6,197,095 | B1 | * | 3/2001 | Ditria et al. | 95/248 |
| 6,207,032 | B1 | | 3/2001 | Buchanan | |
| 6,230,810 | B1 | * | 5/2001 | Rivas | 166/357 |
| 6,263,971 | B1 | * | 7/2001 | Giannesini | 166/366 |

FOREIGN PATENT DOCUMENTS

| | | | |
|---|---|---|---|
| FR | 2 774 924 | | 8/1999 |
| GB | 2226963 | * | 7/1990 |
| GB | 2 242 373 A | | 10/1991 |
| NO | 20015454 | | 11/2001 |
| NO | 20023181 | | 6/2002 |
| WO | WO 01/71158 A1 | | 9/2001 |

OTHER PUBLICATIONS

U.S. patent application Ser. No. 10/360,387, Michaelson et al., filed Feb. 7, 2003.

* cited by examiner

*Primary Examiner*—Thomas B. Will
*Assistant Examiner*—Thomas A. Beach
(74) *Attorney, Agent, or Firm*—Bracewell & Patterson, L.L.P.

(57) ABSTRACT

A method and system for separating and treating water produced from a subsea well includes separating the water subsea, and then separating the water from residual hydrocarbons on a surface vessel. The water treated at the surface, can be dumped to sea or injected into other subsea wells. The residual hydrocarbons separated on the vessel can be conveyed subsea for transportation to a processing facility along with hydrocarbons from the subsea separator. Also, the residual hydrocarbons from the surface separator can be used to fuel gas powered equipment in order to drive other equipment or to generate electricity for the vessel.

19 Claims, 5 Drawing Sheets

SUBSEA WELL PRODUCTION FACILITY

Related Applications

Applicant claims priority to the application described herein through a U.S. provisional patent application titled "Subsea Well Production Facility," having U.S. patent application Ser. No. 60/371,217, which was filed on Apr. 8, 2002, and which is incorporated herein by reference in its entirety.

1. FIELD OF THE INVENTION

1. This invention relates in general to offshore drilling and production equipment, and in particular for treating produced water from a subsea well.

2. BACKGROUND OF THE INVENTION

Well fluid produced from a subsea well typically includes liquid hydrocarbons or oil, gaseous hydrocarbons or natural gas, and water. Transporting water from a subsea well decreases the transportation efficiency and increases the reservoir energy requirements and size of the pump (if used) required to pump the well fluid from the subsea well to a processing facility or to a collection manifold. Typically the processing facility is either on a platform or on land. Further, water in the hydrocarbon stream increases the risk of hydrates and the demand for chemicals to control hydrates."

There is a pilot program in which a subsea separator is placed adjacent a subsea well that separates the produced water from the well fluid. The produced water, which typically includes some residual gaseous and liquid hydrocarbon, is then reinjected into another subsea well. The hydrocarbons exiting the subsea separator are pumped to a fully manned processing facility on a platform. After processing on the platform, the hydrocarbon is conveyed to a transport means. In the pilot program, there must be a pump capable of pumping the oil and gas from the subsea separator to a fully-manned processing facility. Additionally, the water with residual hydrocarbons must be reinjected into a subsea well because it is too contaminated to be released or dumped to sea. Furthermore, reinjecting water into a subsea well can be expensive and is not always feasible; subject to the availability of a suitable subsea reservoir.

SUMMARY OF THE INVENTION

A method and system for separating and treating water produced from a subsea well includes separation of the water from the well fluid at a subsea separator and further separation of the water from residual hydrocarbons on a vessel at the sea surface. The vessel is preferably an unmanned, or not normally manned buoy. The well fluid that contains oil, natural gas, and water is conveyed to the subsea separator where the water is removed and the oil and gas, or produced hydrocarbons, are conveyed to a subsea gathering facility for collection and processing at a facility away from the subsea well. The water removed from the subsea separator, or "dirty water," typically has residual gaseous and sometimes liquid hydrocarbons. The dirty water is pumped to the floating vessel at the surface where the water enters a surface separator. There can be a plurality of individual separators for removing the residual hydrocarbons from the dirty water.

The water exiting from the surface separator, or treated water, is sufficiently clean to be dumped to the sea. Alternatively, the treated water can be combined with sea water that is being injected into another subsea well during well flooding operations. Any liquid residual hydrocarbons, or oil, from the surface separator can be pumped back subsea for collection and processing with the other produced hydrocarbons. The gaseous residual hydrocarbons, or natural gas, can also be transported subsea for further collection and processing with the other produced hydrocarbons. The gaseous residual hydrocarbons can be compressed in order to convey the gaseous residual hydrocarbons subsea, or the gaseous residual hydrocarbons can be mixed with sea water to form a hydrate slurry that is capable of being pumped subsea. Alternatively, the gaseous residual hydrocarbons at the surface vessel can be used as a fuel for gas powered equipment on the vessel or buoy. The gas powered equipment can be used to drive various rotating machinery and generators for providing electricity to the vessel or buoy. Gaseous hydrocarbons from the subsea separator can be pumped with the dirty water or separately to the vessel if more gaseous hydrocarbons are needed to fuel the gas powered equipment.

DETAILED DESCRIPTION OF PREFERRED EMBODIMENT

Figure 1:
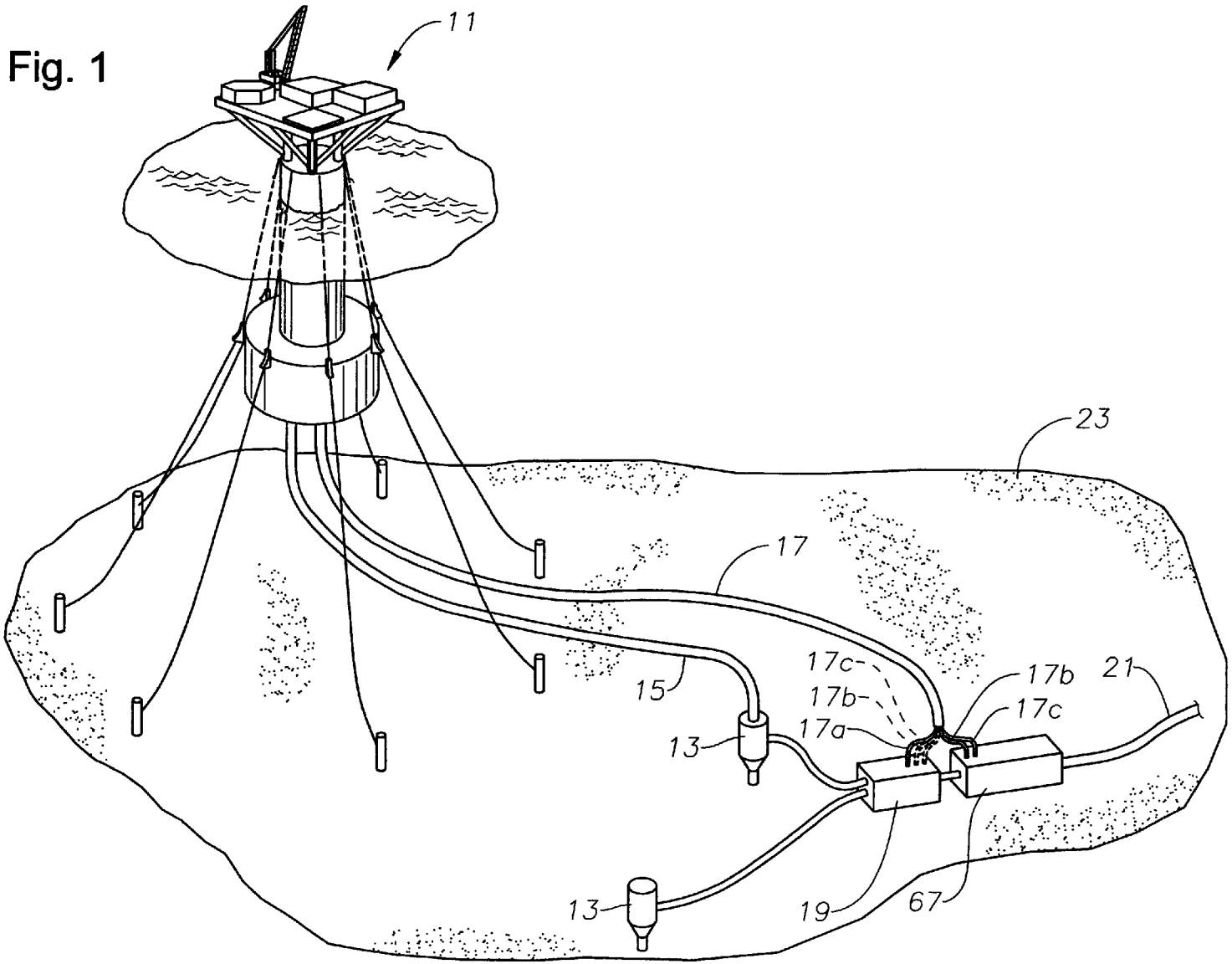
FIG. 1 is a perspective view of a water treatment system constructed in accordance with the present invention.

Referring to FIG. 1, a floating vessel or buoy 11 for subsea wells connects to one or more subsea wellheads 13 of subsea wells by risers 15 and 17. Riser 15 is an optional riser capable of providing a passageway for intervention, communication, and control of the subsea well. In the preferred embodiment, buoy 11 is a floating production buoy, but those skilled in the relevant art will readily appreciate that buoy 11 could also be a tanker. Riser 17 is an optionally insulated and heated riser for the transportation of produced water from a subsea separator 19 to floating support buoy 11, and for the transportation of oil and gas from floating support buoy 11 to a production flow line 21 that runs along the ocean floor 23 to a production platform (not shown). Electricity for heating riser 17 is optionally generated by burning gas from subsea well that is conveyed to buoy 11 by riser 17. Riser 17 has at least two separate flow lines 17*a* and 17*b*.

Subsea separator 19 may be a free-water knockout type, which could be a vertical vessel standing upright, or a horizontal vessel lying on its side. Optionally, subsea separator 19 can be a three-phase separator to separate water, liquid hydrocarbons, and gaseous hydrocarbons from well fluid conveyed from subsea wellhead 13. The water that is separated in subsea separator 19 typically still has gaseous and possibly liquid residual hydrocarbons. The water with gaseous and possibly liquid residual hydrocarbons is "dirty water" or "produced water" that is not acceptable to be dumped into the sea without further treatment. The dirty water that is separated in subsea separator 19 is the produced water that is pumped in riser 17, typically up of flow line 17*a*, to floating support buoy 11 for treatment. The liquid and gaseous hydrocarbons from subsea separator 19 are transported through a production flow line 21 for transportation to a production platform (not shown). In the preferred embodiment, the liquid and gaseous hydrocarbons from subsea separator 19 are communicated from subsea separator to a collector or collection manifold 67, before being pumped through production flow line 21 to a production platform or production facility. Collection manifold 67 can receive liquid and gaseous hydrocarbons from a cluster or a plurality of subsea wells associated with an oil field. The size of a pump (not shown) at collection manifold 67 can be reduced because the pump does not have to pump well fluid containing water to the production platform.

Figure 2:
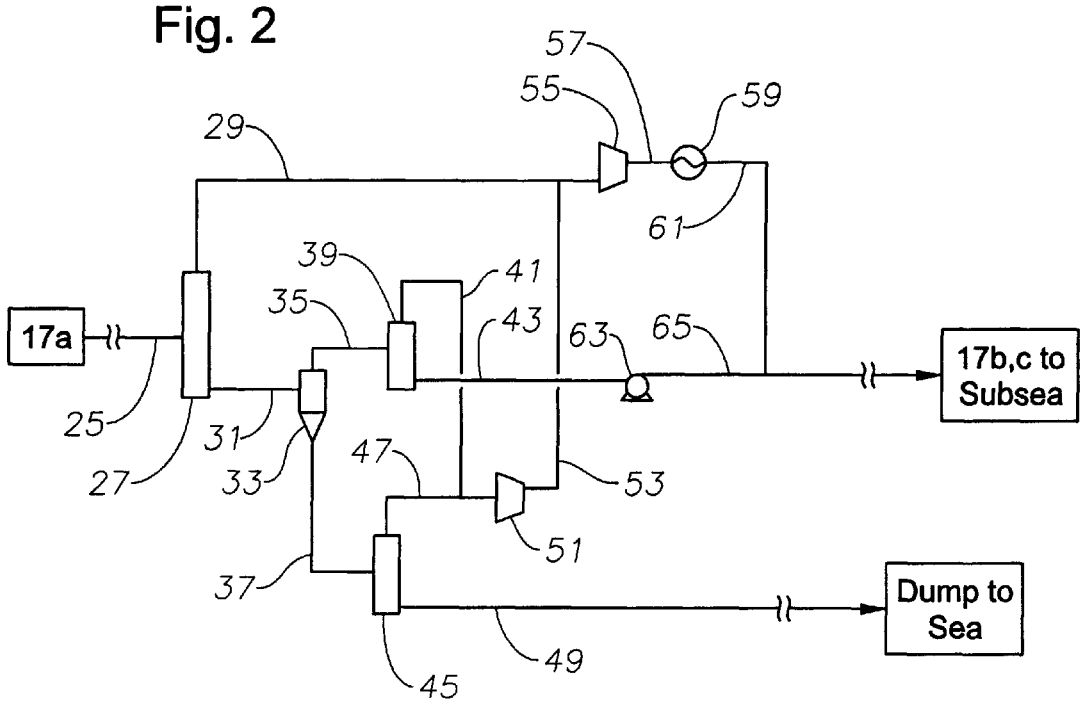
FIG. 2 is a schematic diagram of a portion the water treatment system of FIG. 1 that is located on the vessel shown in FIG. 1.

Referring to FIG. 2, the produced water is treated on buoy 11 in order to separate the remaining oil and gas, or liquid and gaseous residual hydrocarbons, from the dirty water. In the preferred embodiment, the treated water can be discharged into the sea once the dirty or produced water is purified to the desired level. A variety of processing systems may be used to purify the water. FIG. 2 is illustrative of the one system or method of treating the dirty water on buoy 11. A produced water intake 25 receives the produced water coming from riser flow line 17*a* through riser 17 from subsea separator 19. Water intake 25 leads to a first separator or degasser 27, which has a gas outlet flow line 29 and a liquid outlet flow line 31. Degasser 27 may be a static gravity separator. Liquid flow line 31 leads to a second separator 33, which has an oil outlet line 35 and a water outlet line 37. In the preferred embodiment, second separator is a liquid separator for separating water from liquid residual hydrocarbons. As shown in FIG. 2, second separator 33 is a hydrocyclone, which separates oil and water using a vortex principle. A hydrocyclone is a preferable apparatus for second separator 33 because there are no moving parts, and therefore requires minimal maintenance.

As the buoy is unmanned, or not normally manned, an automatic oil reject backflushing procedure may be provided for the hydrocyclone 33 unit in order to avoid build up of solids in the oil reject ports (not shown), which have a typical diameter of 2.0 mm. This involves automation of two isolation valves (not shown) as a small stream of the inlet flow from line 31 is routed directly to the oil outlet line 35, upstream of a closed isolation valve (not shown). A desanding system upstream of the hydrocyclone 33, in outlet line 31, may be included to avoid erosion/settling in the inlet chamber of hydrocyclone 33 and secure high availability for the unit. Hydrocyclone systems are simple and have no moving parts. They have high reliability if operated correctly and if fluids are suitable. They have minimal maintenance requirements. However, there are disadvantages for using hydrocyclones on the buoy 11. With separator 19 at sea floor 23, the temperature of the oily water will be lower than what is normally the case. This makes it more difficult to reach the oil in water output specification. Another general disadvantage of hydrocyclone units is the relatively high pressure drop.

An example of an alternative for second separator 33 is a CODEFLO (Compact Degassing and Flotation system). A patent on the CODEFLO system itself is pending, its application number is PCT/NO00/00243, which we are incorporating by reference. The CODEFLO system consists of the following main process steps: the degasser process; coagulation step (two steps if high turndown is required); and, the flotation process. Each of these main process steps are described in more detail in PCT/NO00/00243. The CODEFLO system in the second embodiment has the advantages of small size, low weight, low pressure drop, high separation efficiency and ease of operation. Disadvantages include the consumption of chemicals and related potential problems.

For both the hydrocyclone and the CODEFLO embodiments, the produced water will be treated to local discharge standards or better. This produced water stream would be monitored with an automated water quality meter (not shown). These meters are typically automated optical sensors, which can be configured to give readings back to a central SCADA system and interrogated remotely (a requirement for unmanned buoy applications.) These units are set up to be relatively maintenance free, self-diagnosing and self flushing/cleaning with remote diagnostics.

Referring back to FIG. 2, oil outlet line 35 from second separator 33 connects to a third separator 39, which is preferably another degasser having a gas outlet line 41 and an oil outlet line 43. Water outlet line 37 leads to a fourth separator 45, which is also another degasser having a gas outlet line 47 and a water outlet line 49. A first compressor 51 has an intake connected to gas outlet line 47. Compressor 51 has a compressed gas outlet line 53 that joins the intake of a second compressor 55, which has an outlet line 57. An air cooler 59 with a gas outlet flow line 61 has an inlet that receives compressed gaseous hydrocarbons from outlet line 57 of compressor 55. Second degasser oil outlet line 43 connects to a single phase oil pump 63 with an oil outlet flow line 65. Oil and gas outlet lines 61 and 65 connect to riser 17 to pump the oil and gas back down to a subsea manifold 67 and production flow line 21.

Referring back to FIG. 1, riser 17 carrying the water from subsea separator to the processing equipment on floating support buoy 11 may be insulated and/or heated so that the water temperature remains above a desired temperature. Insulating and, if necessary, heating flow line 17*a* of riser 17 can reduce the formation of hydrates in the water and residual hydrocarbons. Hydrates forming in flow line 17*a* reduce the flow rate of the water and increase the required head required to pump the water to buoy 11 at the surface. Reducing the formation of hydrates in flow line 17*a* helps reduce the problems and associated maintenance associated transported water with residual hydrocarbons from sea floor 23 to buoy 11 at the surface. If necessary, heating elements may also be located in riser 17 to ensure the temperature of the produced water stays above a desired minimum temperature.

In operation, well fluid containing oil, gas, and water is collected in and initially separated by subsea separator 19. The dirty or produced water from subsea separator 19 is transported through riser 17 to floating support buoy 11. The dirty water passes through first surface separator 27, which is preferably a degasser, for further removal of gas. The lower temperature and pressure of the produced gas in first separator 27, versus the pressure and temperature conditions in subsea separator 19, more readily allows the gaseous residual hydrocarbons to separate from the produced water. The gas that separates from the produced water exits first surface separator 27 into gas flow line 29.

Liquid residual hydrocarbons and water exit first surface separator 27 into liquid outlet flow line 31, which takes the oil and water to second surface separator 33. In the preferred embodiment, second separator 33 is a hydrocyclone that uses centrifugal forces to separate the heavier water from the lighter oil or liquid residual hydrocarbons. Water exists second surface separator 33 into water outlet line 37 after the oil and water are separated. Oil from second separator 33 exits into oil outlet line 35 and goes to third surface separator 39, which is another degasser. Third surface separator 39 can be a vertically oriented vessel that allows any remaining gas to separate from the oil. The gas discharges from third separator 39 into gas outlet line 41. After the remaining gas is separated from the oil in third separator 39, the remaining oil exits third separator 39 into oil outlet line 43, which transports the liquid residual hydrocarbons from the dirty water to pump 63. Pump 63 then pumps the oil into pump outlet line 65, which will take the oil back down riser 17, preferably through flow line 17*b*, to subsea collection manifold or collector 67. From the subsea gathering manifold 67, the oil enters production flow line 21 to be taken to a processing platform or facility.

Water outlet line 37 takes the water and any remaining gaseous residual hydrocarbons from second separator 33 to fourth surface separator 45. Fourth surface separator 45 is preferably another degasser and can be a vertical vessel that allows any remaining gas in the water stream to separate. Fourth separator 45 discharges the remaining water into water outlet line 49. Water in water line 49 is fully treated. In the embodiment shown in FIG. 2, the treated water is dumped to sea from water line 49.

Figure 6:
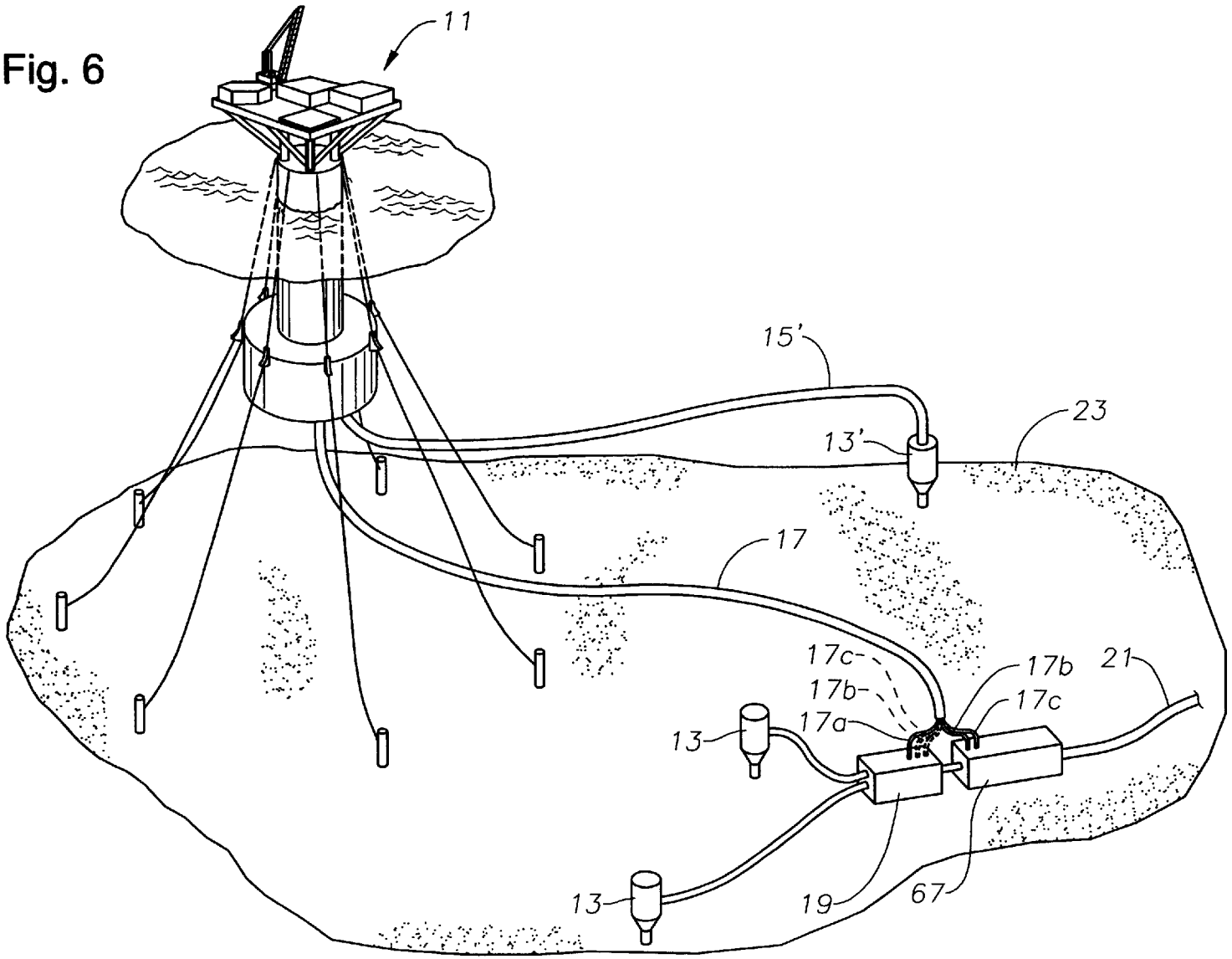
FIG. 6 is a perspective view of an alternative embodiment of the water treatment system of FIG. 1.

Referring to FIG. 6, in an alternative embodiment, the treated or processed water is combined with sea water that is then pumped down an injection riser 15' to a subsea wellhead 13' located on a subsea well during water flood operations. Subsea water injection wells have water injected into the well to help production of hydrocarbons at other wells that are producing from the same field.

Referring back to the embodiment shown in FIG. 2, fourth surface separator 45 discharges the remaining gas or gaseous residual hydrocarbons into gas outlet line 47. The gaseous hydrocarbons from fourth surface separator flows through gas outlet line 47 and joins the gas in gas outlet line 41 coming from third surface separator 39. In this embodiment, the gases from surface separators 39 and 45 then enter first compressor 51. First compressor 51 increases the pressure of the gas so that it is substantially equal to the gas pressure of the gas in gas outlet line 29 coming from first surface separator 27. Gas from outlet lines 41 and 47 is compressed in first compressor 51 and exits first compressor 51 into gas outlet line 53, which transports the compressed gas to mix with the gas in gas outlet line 29.

In the embodiment shown in FIG. 2, all the gaseous residual hydrocarbons that are separated by surface separators 27, 41, and 45 flow to second compressor 55. Second compressor 55 increases the gas pressure in order to convey the gaseous residual hydrocarbons back down riser 17, either in flow line 17*b* or a separate additional flow line 17*c*, to subsea collection manifold 67. Flow lines 17*b* and 17*c* are shown in FIG. 1 as connecting to collection manifold 67.

Dotted line representations also show, alternatively, that flow lines 17*b* and 17*c* can also be connected to the intake of subsea separator 19. In the embodiment shown with dotted line representations of flow lines 17*b* and 17*c*, the liquid and gaseous hydrocarbons that were removed from the dirty water at the surface are then conveyed into subsea separator 19 before being transported to collection manifold 67. As will be appreciated by those skilled in the art, flow lines 17*b* and 17*c* could also be connected to a produced hydrocarbons flow line that transports hydrocarbons from subsea separator 19 when there is not a collection manifold 67.

Referring back to the embodiment shown in FIG. 2, before the gas enters riser 17 to go back down to subsea gathering manifold 67, the gas may be cooled after compression. Second compressor 55 discharges the high pressure gas into gas outlet line 57, which takes the compressed gas to air cooler 59 to cool the exiting gas. The gas coming out of air cooler 59 enters gas outlet line 61. The gas in outlet line 61 is now cool enough and pressurized enough for conveyance down riser 17 to subsea gathering manifold 67 or back into subsea separator 19. With respect to cooler 59, air is the preferred medium for cooling the gas after compression over sea water because scaling problems occur in sea water at high temperature.

Figure 3:
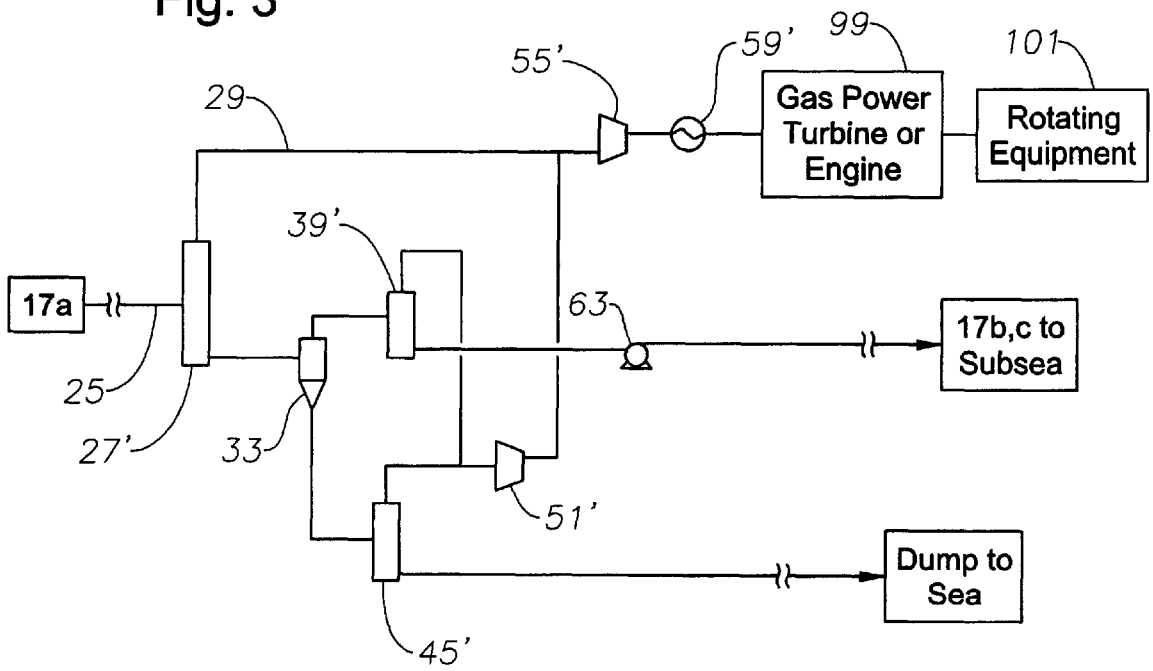
FIG. 3 is a schematic diagram of an alternative embodiment of the water treatment system of FIG. 1.

The embodiment illustrated in FIG. 3, is an alternative embodiment that uses the gaseous residual hydrocarbons to power buoy or vessel 11 rather than conveying the gas to subsea collector 67. Gas from degasser surface separators 27', 39', 45' are in fluid communication with a gas powered apparatus 99 to provide mechanical power to consumer 101. Preferably, there are a plurality of gas powered apparatuses 99, which are also typically either gas powered engines or gas turbines. Typically, gas powered equipment 99 drives a generator for supplying electrical power to the buoy 11, or other pieces of rotating equipment like pumps or compressors. Those skilled in the art, however, will readily appreciate that gas powered equipment can drive a variety of other pieces of rotating equipment. First and second compressors 51', 55' and cooler 59' are shown in FIG. 3, but may be modified, used, or not used to meet the inlet conditions desired for gas fuel entering particular gas powered apparatuses 99.

Figure 4:
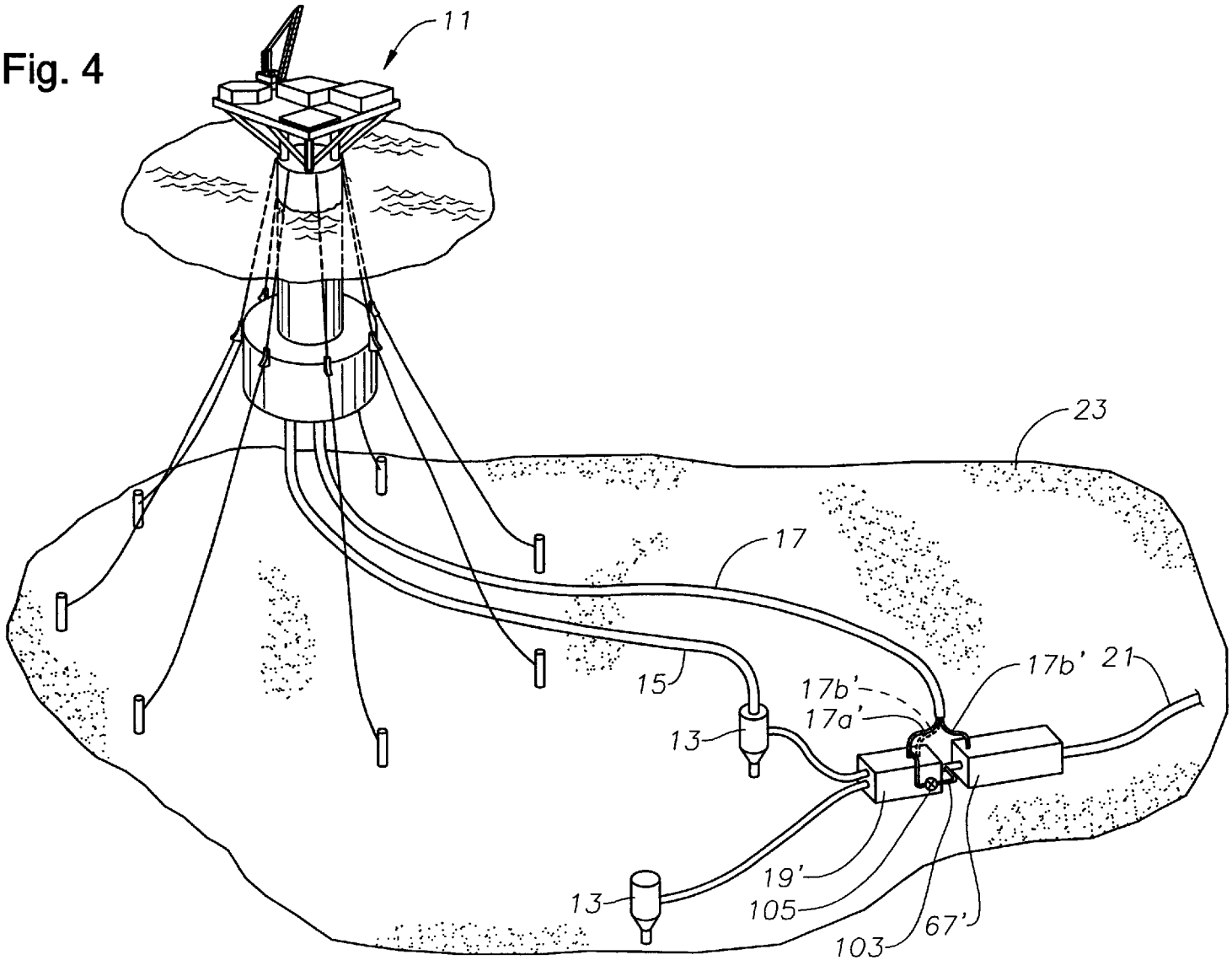
FIG. 4 is a perspective view of alternative embodiment of the water treatment system of FIG. 3.

In connection with alternative embodiment shown in FIG. 3, FIG. 4 illustrates an optional system for supplying additional fuel to gas powered apparatuses 99. As shown in FIG. 4, an additional flow line 103 extends from a gas outlet of subsea separator 19' to flow line 17*a*'. Flow line 103 preferably has a one-way, remote actuated valve 105 for regulating flow between riser flow line 17*a*' and the gas outlet of subsea separator 19'. Flow line 103 transports a portion of the gaseous hydrocarbons from subsea separator 19' to flow line 17*a*'. If fuel requirements of gas powered equipment on buoy 11 are greater than the amount of gaseous residual hydrocarbons produced from treatment of the dirty water at buoy 11, valve 105 is opened so that more gaseous hydrocarbons are conveyed up riser 17*a*' with the dirty water to buoy 11. When the amount of gaseous fuel produced from the treatment of the dirty water at buoy is sufficient for gas powered equipment 99, valve 105 is closed so that the gaseous hydrocarbons exit subsea separator 19', and are conveyed to subsea collector 67' for transportation to the production facility or platform.

Figure 5:
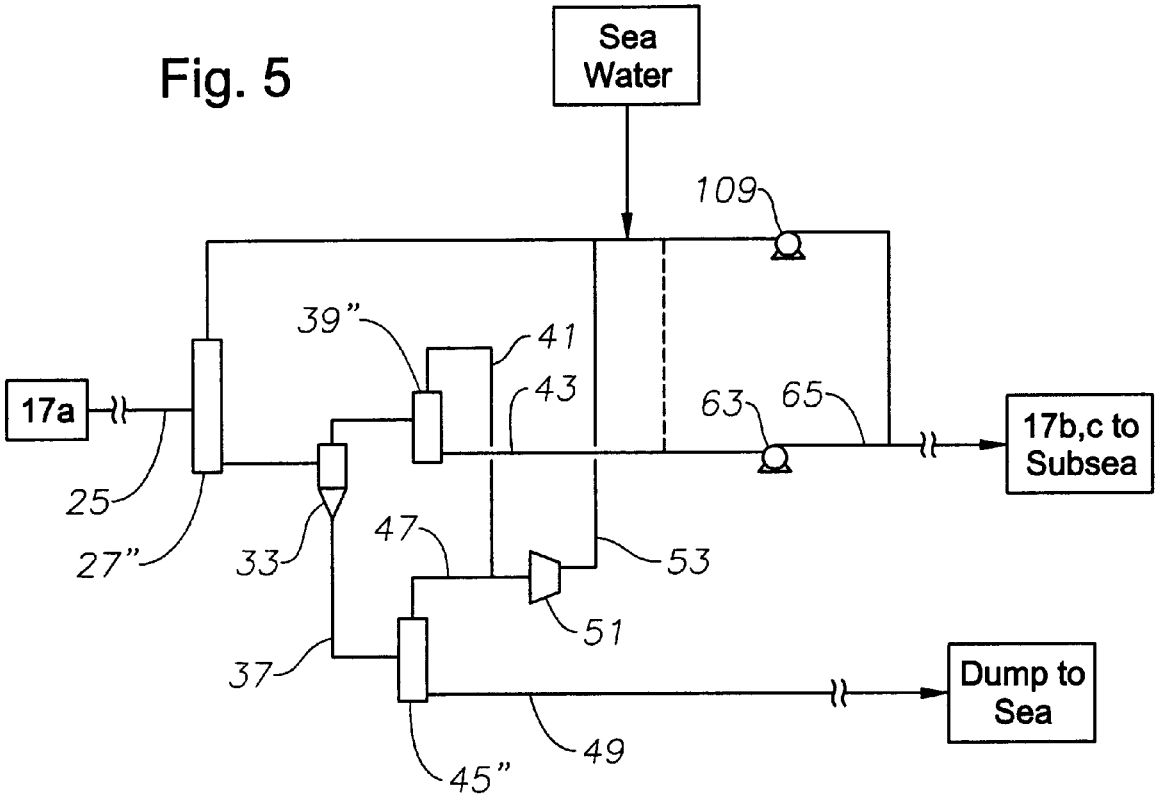
FIG. 5 is a schematic diagram of an alternative embodiment of the portion of the water treatment system of FIG. 2.

FIG. 5 shows another alternative embodiment for the treatment of the gaseous residual hydrocarbons at the buoy. Unlike the embodiments discussed above in FIGS. 1–4, there is no second compressor 55 and aftercooler 59. In this alternative embodiment, the gaseous residual hydrocarbons from separators 27", 39", 45" combine with sea water from a sea water intake 107 on buoy 11. Adding sea water causes the formation of a hydrate slurry from the gaseous residual hydrocarbons and the sea water. A hydrate slurry is made up of flowable hydrates of relatively small amounts of gas and the injection water. This process is described in detail in a Norwegian patent application on hydrate slurry injection, Norwegian Nr. 2000-4337. The hydrate slurry process is described in detail in the above-referenced application, but can be characterized as the combination of water and the produced natural gas to make a hydrate slurry which is pumpable. By forming a hydrate slurry, compressor 55 and aftercooler 59 (FIGS. 1–4) are no longer necessary to convey the gaseous residual hydrocarbons from buoy 11. Instead, the hydrate slurry can feed into either an additional pump 109, which pumps the hydrate slurry into outlet line 65" that feeds into riser flow line 17*b* from communication to subsea collector 67. Alternatively, as represented by the dotted lines, the hydrate slurry could flow directly into existing pump 63" that is pumping liquid residual hydrocarbons to subsea collector 67. Conveying the hydrate slurry directly to pump 63" would remove the need for pump 109, but would increase the capacity requirements of pump 63". The system shown in FIG. 5 is advantageous because the maintenance and power requirements of pumps are generally less than compressors, which would be beneficial buoy 11 when it is unmanned.

Further, it will also be apparent to those skilled in the art that modifications, changes and substitutions may be made to the invention in the foregoing disclosure. Accordingly, it is appropriate that the appended claims be construed broadly and in the manner consisting with the spirit and scope of the invention herein. For example, as an alternative to including third separator 39 for receiving liquid residual hydrocarbons from the hydrocyclone or second surface separator, a multiphase pump capable of pumping liquids and gases may be installed instead of the single phase oil pump 63.

That claimed is:

1. A method for producing a subsea well, comprising:

conveying well fluid from a subsea well to a subsea separator;

separating water from the well fluid with the subsea separator to produce water with residual hydrocarbons and hydrocarbon liquids;

conveying the hydrocarbon liquids directly to a subsea collector for transportation to a remote processing facility;

pumping the water with the residual hydrocarbons to a vessel at the surface; and then separating the water from the residual hydrocarbons with a separator at the vessel.

2. The method of claim 1, further comprising pumping the water after separation from the residual hydrocarbons to the sea.

3. The method of claim 1, further comprising mixing the water after the separation from the residual hydrocarbons with a supply of sea water, and injecting the mixture into another subsea well.

4. The method of claim 1, further comprising conveying the residual hydrocarbons after separation at the vessel to the subsea collector for conveyance to the remote processing facility.

5. The method of claim 4, further comprising with the separator on the vessel, separating gaseous hydrocarbons and liquid hydrocarbons from the residual hydrocarbons; and pumping the liquid hydrocarbons to the subsea collector.

6. The method of claim 5, further comprising with the separator on the vessel, separating gaseous hydrocarbons and liquid hydrocarbons from the residual hydrocarbons; and conveying the gaseous hydrocarbons to the subsea collector.

7. The method of claim 1, further comprising adding sea water to the gaseous residual hydrocarbons to form a hydrate slurry, then pumping the hydrate slurry to the subsea collector for conveyance to the remote processing facility.

8. The method of claim 1, further comprising:

separating gas from the residual hydrocarbons with the separator at the vessel;

burning the gas and generating electricity with the burned gas.

9. The method of claim 1, further comprising:

providing at least one gas powered apparatus on the vessel, the gas powered apparatus having a fuel intake and is in fluid communication with the separator at the vessel; and then supplying gaseous residual hydrocarbons from the separator at the vessel to the fuel intake of the gas powered apparatus.

10. The method of claim 9, further comprising supplying additional hydrocarbons to the gas powered apparatus by adding gaseous hydrocarbons to the separated water after separation with the subsea separator.

11. A method for producing a subsea well, comprising:

separating water from well fluid produced by a subsea well with a subsea separator; then pumping the water with residual hydrocarbons to a vessel at the surface, and conveying hydrocarbons remaining after the separation of the water with the subsea separator to a subsea collector;

separating the water from the residual hydrocarbons with a surface separator located at the vessel;

separating liquid residual hydrocarbons from gaseous residual hydrocarbons of the residual hydrocarbons; and pumping the liquid residual hydrocarbon to the subsea collector.

12. The method of claim 11, further comprising pumping the water separated from the residual hydrocarbons with the surface separator to the sea.

13. The method of claim 11, further comprising conveying the gaseous residual hydrocarbons from the surface separator to the subsea collector.

14. The method of claim 11, further comprising:

burning the gaseous residual hydrocarbons at the vessel and generating electricity thereby;

providing a riser for conveying the water and residual hydrocarbons to the vessel; and heating the riser with the electricity generated to reduce the formation of hydrates in the water and residual hydrocarbons communicating to the vessel.

15. The method of claim 11, further comprising compressing the gaseous residual hydrocarbons after separation with the surface separator before conveying the gaseous residual hydrocarbons to the subsea collector.

16. The method of claim 11, further comprising adding sea water to the gaseous residual hydrocarbons after separation by the surface separator to form a hydrate slurry, then pumping the hydrate slurry with the liquid residual hydrocarbons to the subsea collector.

17. The method of claim 11, further comprising:

burning the gaseous residual hydrocarbons at the vessel and producing electricity.

18. The method of claim 17, further comprising separating the hydrocarbons flowing from the subsea well to the subsea separator into liquid and gaseous hydrocarbons;

and conveying a portion of the gaseous hydrocarbons from the subsea separator to the vessel;

and burning the gaseous hydrocarbons along with the gaseous residual hydrocarbons to produce electricity.

19. A well fluid treatment system, comprising:

a vessel;

a subsea separator adapted to be located adjacent a subsea well for separating water from well fluid from a subsea well;

a riser extending from a water outlet of the subsea separator to the vessel;

a subsea collector which receives the hydrocarbons from a hydrocarbon outlet of the subsea separator and conveys them to a facility for process; and a surface separator on the vessel for receiving the water from the riser and for separating residual hydrocarbons from the water.

* * * * *